US008365333B2

(12) United States Patent
Bae et al.

(10) Patent No.: US 8,365,333 B2
(45) Date of Patent: Feb. 5, 2013

(54) LAUNDRY MACHINE AND CONTROLLING METHOD THEREOF

(75) Inventors: Sang Hun Bae, Changwon-si (KR); Jung Wook Moon, Changwon-si (KR); Chul Jin Choi, Changwon-si (KR); Dong Hyun Kim, Changwon-si (KR); Young Bok Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 743 days.

(21) Appl. No.: 12/309,193

(22) PCT Filed: Jul. 10, 2007

(86) PCT No.: PCT/KR2007/003339
§ 371 (c)(1),
(2), (4) Date: Nov. 17, 2009

(87) PCT Pub. No.: WO2008/007889
PCT Pub. Date: Jan. 17, 2008

(65) Prior Publication Data

US 2010/0064446 A1 Mar. 18, 2010

(30) Foreign Application Priority Data

Jul. 10, 2006 (KR) ..... 10-2006-0064300

(51) Int. Cl.
*D06F 35/00* (2006.01)

(52) U.S. Cl. ..... 8/158; 8/159; 68/3 R; 68/5

(58) Field of Classification Search ..... 68/3 R
See application file for complete search history.

(56) References Cited

U.S. PATENT DOCUMENTS

| | | | | |
|---|---|---|---|---|
| 2005/0132503 | A1 * | 6/2005 | Yang et al. | 8/149.3 |
| 2006/0016020 | A1 * | 1/2006 | Park | 8/158 |
| 2006/0101586 | A1 * | 5/2006 | Park et al. | 8/149 |
| 2006/0117596 | A1 * | 6/2006 | Kim et al. | 34/607 |

FOREIGN PATENT DOCUMENTS

| | | |
|---|---|---|
| KR | 10-2003-0078508 | 10/2003 |
| KR | 10-2005-0060566 | 6/2005 |
| WO | WO 2005/001189 A1 | 6/2005 |

* cited by examiner

*Primary Examiner* — Michael Barr
*Assistant Examiner* — Jason Ko
(74) *Attorney, Agent, or Firm* — McKenna Long & Aldridge LLP

(57) ABSTRACT

The present invention relates to a laundry machine and a method for controlling the same, wherein the laundry machine includes a steam generator (300) for generating and supplying steam to a drum (130) and a detergent liquid flow passage (340) for providing a passage to supply detergent liquid to an inside of the steam generator (300), thereby permitting easy washing of the steam generator (300) in the laundry machine.

22 Claims, 3 Drawing Sheets

[Fig. 1]
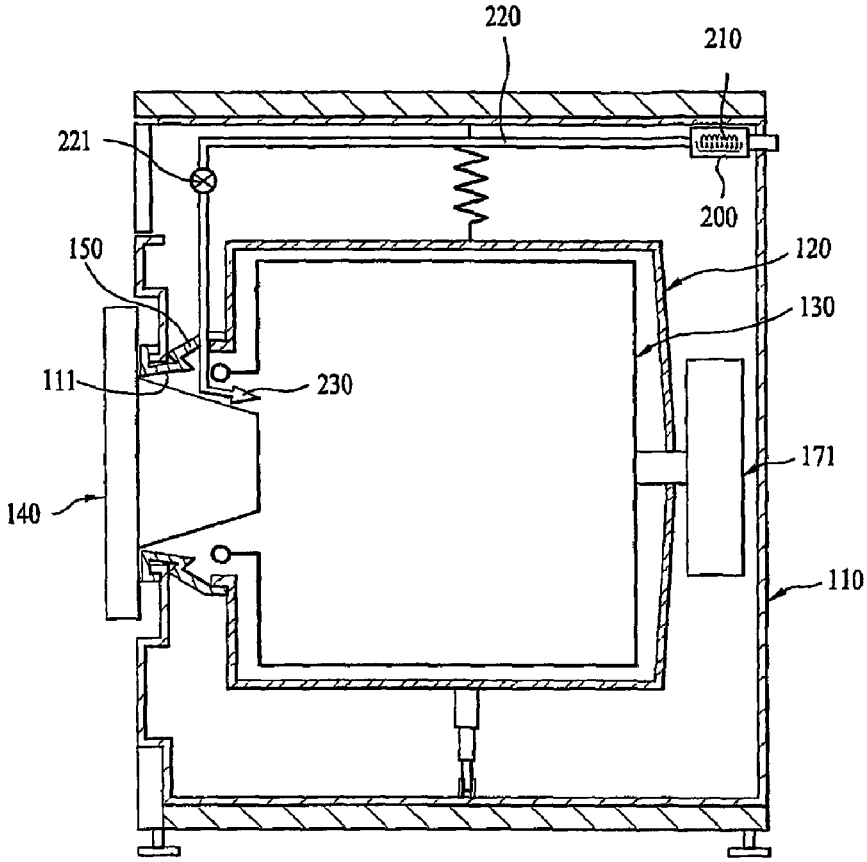
[Fig. 2]
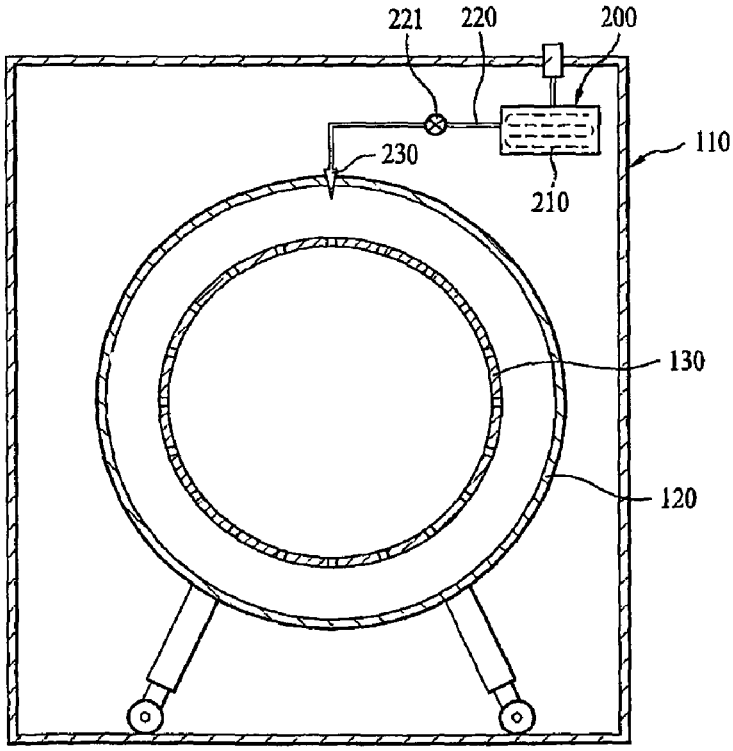

[Fig. 3]
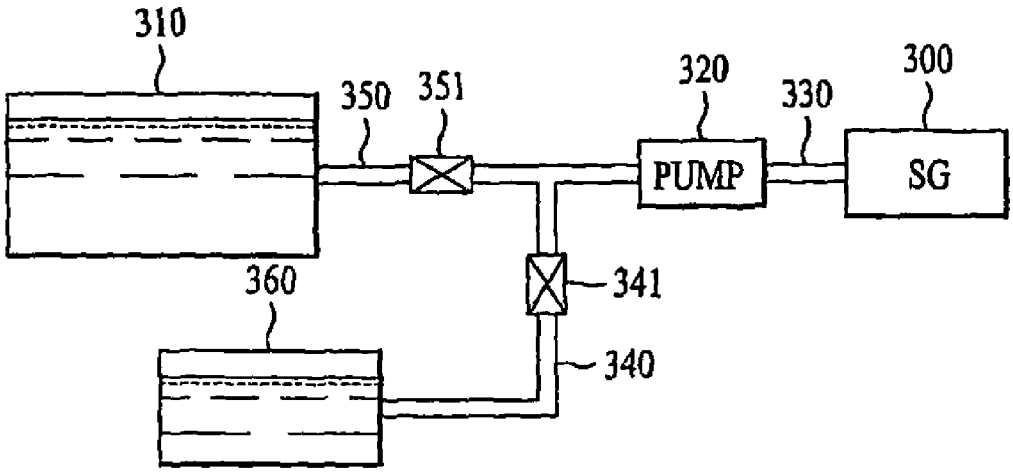
[Fig. 4]
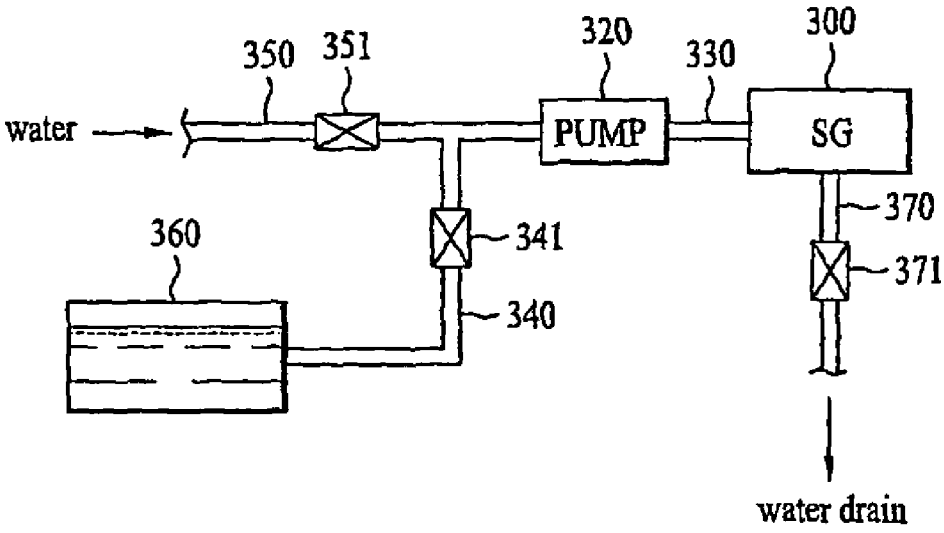

[Fig. 5]
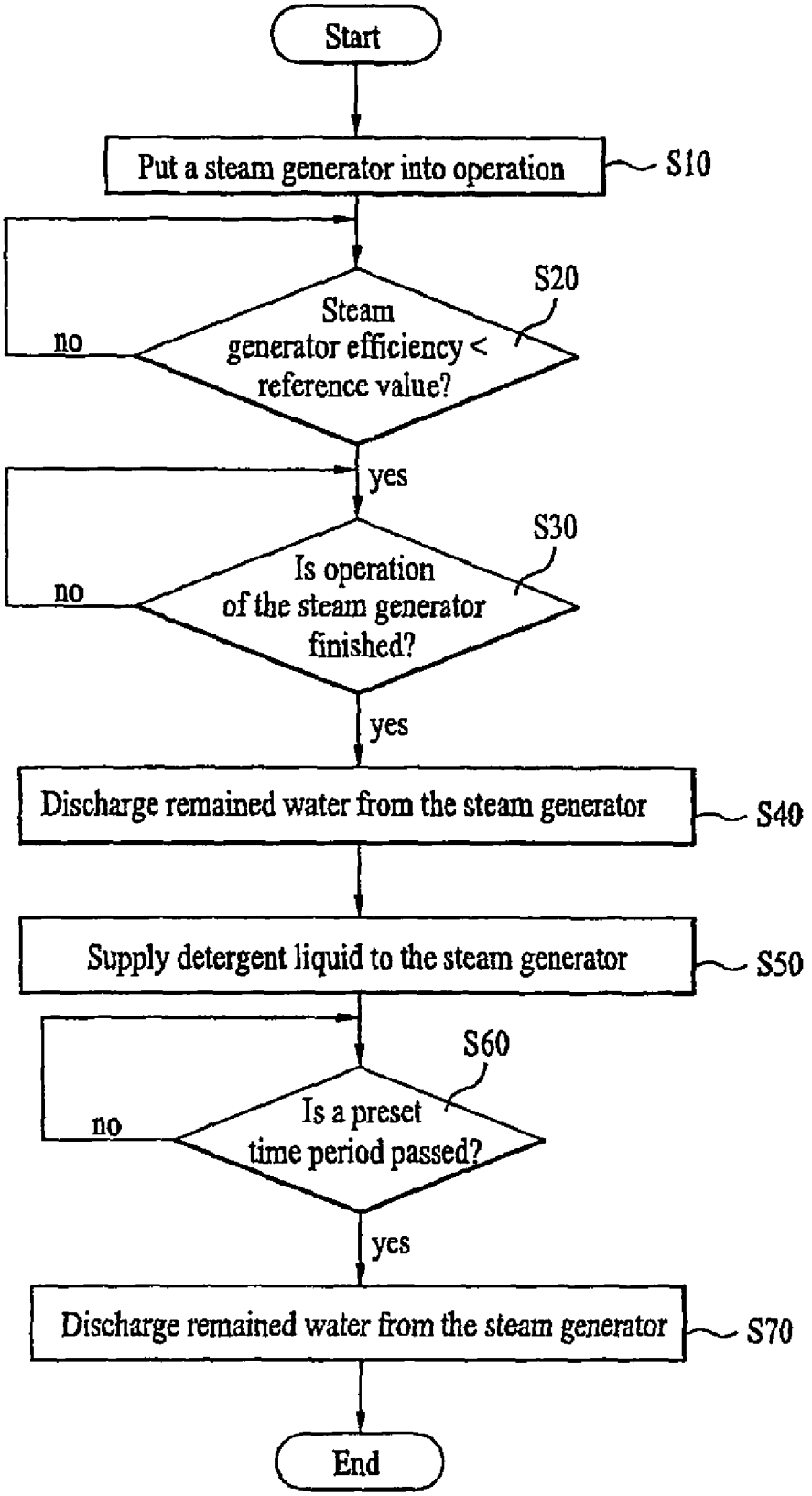

LAUNDRY MACHINE AND CONTROLLING METHOD THEREOF

This application is a National Stage Entry of International Application No. PCT/KR2007/003339, filed Jul. 10, 2007, and claims the benefit of Korean Application No. 10-2006-0064300, filed on Jul. 10, 2006, which is hereby incorporated by reference for all purposes as if fully set forth herein.

TECHNICAL FIELD

The present invention relates to laundry machines, such as washing machines or dryers. More specifically, the present invention relates to a laundry machine which enables washing of an inside of a steam generator provided therein, and a method for controlling a laundry machine in the washing.

BACKGROUND ART

Generally, the washing machine, performing washing, rinsing, spinning, and so on by rotating a rotating tub and a pulsator with driving force of a motor, is an appliance for performing washing by using friction between laundry, and washing water and a rotating tub.

According to washing systems, in the washing machines, there are pulsator type washing machines, agitating type washing machines, drum type washing machines, and so on.

In general, the drum type washing machine washes laundry by using friction between the laundry and a washing drum rotated by driving force of a driving unit in a state detergent, washing water and the laundry are introduced to the washing drum, is designed to show no entangling of, and damage to, the laundry, and provide a washing effect of pounding and rubbing.

In the meantime, the laundry dryer is an appliance for automatic drying of a wet washed drying object (for an example, clothes).

Currently, of above laundry machines, there is a laundry machine having a steam generator provided thereto.

As an example, FIGS. 1 and 2 illustrate related art washing machines each having the steam generator.

The related art washing machine is a drum type washing machine provided with a body 110, a tub 120, a drum 130, a driving motor 171, and the steam generator 200.

The body 110 forms an exterior of the drum type washing machine, and the tub 120 is mounted in, and supported on the body 110.

The drum 130 is rotatably mounted in the tub 120, with an opening positioned to face a laundry opening 111 in the body 110.

A door 140 is mounted to a portion having the laundry opening in the body 110 formed therein, and on an inside circumference of the laundry opening 111, there is a rim 150 for sealing between the door 140 and the laundry opening 111.

The driving motor 171, a motor for rotating the drum 130, is connected to rotate the drum 130 directly.

The steam generator 200 turns water into steam and provides the steam to an inside of the drum 130.

The steam generator 200 has a heater provided therein for heating the water to generate the steam. The steam from the steam generator 200 flows along a steam supply tube 220, and is supplied to the drum 130 through a spray nozzle 230.

DISCLOSURE OF INVENTION

Technical Problem

However, the related art laundry machine has a problem in that washing of an inside of the steam generator is difficult. As time passes by, the inside of the steam generator is liable to contaminate, to fail to supply clean steam.

What is more important is that the contamination of the inside of the steam generator is liable to impair efficiency of the steam generator. Particularly, contaminants stuck to an outside of the heater impair efficiency of the heater.

Of the contaminants, what can cause a problem is calcareous. If hard water is boiled, the calcareous deposits, mostly, on a surface of the heater, which impairs the efficiency of the heater, significantly.

Particularly, above problem is very serials in a place where a quality of water is comparatively poor, like Europe.

Technical Solution

An object of the present invention is to solve above problem.

That is, the object of the present invention is to provide a laundry machine which enable washing of an inside of a steam generator.

Particularly, an object of the present invention is to provide a laundry machine which can prevent efficiency of a steam generator from dropping by removing calcareous, as contaminant, in the steam generator.

Another object of the present invention is to provide a method for operating a laundry machine in washing an inside of a steam generator.

To achieve these objects and other advantages and in accordance with the purpose of the invention, as embodied and broadly described herein, a laundry machine includes a steam generator for generating and supplying steam to a drum, and a detergent liquid flow passage for providing a passage to supply detergent liquid to an inside of the steam generator.

Preferably, the laundry machine may further include a detergent liquid container connected to the detergent liquid flow passage for holding the detergent liquid, and the detergent liquid container is detachable.

The laundry machine may further include a water container for holding water to be supplied to the steam generator, and a water flow passage connected between the steam generator and the water container. the water container may be detachable.

In the meantime, the laundry machine may further include a pump mounted to the detergent liquid flow passage or the water flow passage for running in a regular or reverse direction, selectively.

The laundry machine may further include opening/closing means for enabling selective communication either between the steam generator and the water container, or between the steam generator and the detergent liquid container.

The opening/closing means may include a detergent liquid valve mounted to the detergent liquid flow passage for making selective communication between the steam generator and the detergent liquid container, and a water valve mounted to the water flow passage for making selective communication between the steam generator and the water container.

The opening/closing means may include a three-way valve for making selective communication between the steam generator and the detergent liquid flow passage or the water flow passage.

In the meantime, the laundry machine may further include a control unit for determining whether the steam generator is washed or not and a washing time thereof, to control the pump and the opening/closing means.

In this instance, in a case the detergent liquid is supplied to the steam generator, the control unit may control the opening/closing means to make the steam generator and the detergent liquid container in communication, and the pump to run to supply the detergent liquid to the steam generator.

In a case water is discharged from the steam generator, the control unit may control the opening/closing means to make the steam generator and the water container in communication, and the pump to run to discharge the water to the water container.

The control unit senses a temperature of the water in the steam generator for determining whether the inside of the steam generator is washed or not.

The control unit may determine whether the inside of the generator is washed or not by comparing a time period taken in a case the water temperature of the inside of the steam generator rises from a preset first temperature to a preset second temperature to a reference time period, or a water temperature in a case the water in the steam generator is heated for a preset time period to the reference temperature.

In the meantime, the control unit determines whether the steam generator is washed or not by sensing a heat generation rate of the heater in the steam generator, preferably the control unit controls the laundry machine such that the steam generator is washed after the steam generator is stopped.

The laundry machine may further include a discharge flow passage for discharging the liquid from the steam generator to at least one of the tub, the washing water discharge pump, and the washing water discharge hose.

In the meantime, in another aspect of the present invention, a method for controlling a laundry machine includes the steps of determining whether an inside of a steam generator is washed or not, discharging remained water from the inside of the steam generator, supplying detergent liquid to the inside of the steam generator, and discharging the detergent liquid from the inside of the steam generator.

BRIEF DESCRIPTION OF THE DRAWINGS

FIGS. 1 and 2 illustrate sections of related art laundry machines, respectively;

FIG. 3 illustrates a diagram of a system of a laundry machine in accordance with a preferred embodiment of the present invention, schematically;

FIG. 4 illustrates a diagram of a system of a laundry machine in accordance with another preferred embodiment of the present invention, schematically; and FIG. 5 illustrates a flow chart showing the steps of a method for controlling a laundry machine as shown in FIG. 3.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

FIG. 3 illustrates a portion of a laundry machine in accordance with a preferred embodiment of the present invention. FIG. 4 illustrates a portion of a laundry machine in accordance with another preferred embodiment of the present invention.

FIGS. 3 and 4 illustrate characteristic portions of the laundry machines in accordance with preferred embodiments of the present invention only, and other portions thereof are no different from the related art laundry machine. Accordingly, only the characteristic portions will be described herein, and other portions will be omitted.

Referring to FIG. 3, the laundry machine includes a steam generator 300, a water container 310, and a detergent liquid container 360. The water container 310 has an exclusive water flow passage 350 connected thereto, and the detergent liquid container 360 has an exclusive detergent liquid flow passage 340 connected thereto. Preferably, the water container 310, and the detergent liquid container 360 are detachably mounted to the laundry machine.

The exclusive water flow passage 350 and the exclusive detergent liquid flow passage 340 are connected to a common flow passage 330 connected to the steam generator.

That is, a water flow passage is constructed of the exclusive water flow passage 350 and the common flow passage 330 for supplying water from the water container 310 to the steam generator 300, and a detergent liquid flow passage is constructed of the exclusive detergent flow passage 340 and the common flow passage 330 for supplying detergent liquid from the detergent liquid container 360 to the steam generator 300.

The exclusive water flow passage 350 has a water valve 351 mounted thereto, and the exclusive detergent liquid flow passage 340 has a detergent liquid valve 341 mounted thereto. As the valves 341, and 351 are opened, the flow passages 340 and 350 are opened, respectively.

In the meantime, it is preferable that the common flow passage 330 has a pump 320 mounted thereto. Regular direction running and reverse direction running of the pimp 320 will be discussed. If the pump 320 runs in the regular direction, the water or the detergent liquid is pumped from the water container 310 or the detergent liquid container 360 to the steam generator 300.

If the pump 320 runs in the reverse direction, liquid is directed from the steam generator 300 to the exclusive water flow passage 350 or the exclusive detergent liquid flow passage 340. In this instance, if the water valve 351 is opened and the detergent liquid valve 341 is closed, the liquid is pumped from the steam generator 300 to the water container 310. In the meantime, if the pump 320 runs in the reverse direction, it is liable that a portion of the liquid pumped from the steam generator 300 remains in the exclusive detergent liquid flow passage 340. That is, the portion of the liquid is liable to remain between a point where the exclusive water flow passage 350 and the exclusive detergent flow passage 340 join together and the detergent liquid valve 341.

Though not shown, for preventing this, it is preferable that a 3-way valve is mounted to the point where the exclusive water flow passage 350 and the exclusive detergent flow passage 340 join together. In this case, the water valve 351 and the detergent liquid valve 341 can be dispensed with, and the 3-way valve substitutes functions of the water valve 351 and the detergent liquid valve 341.

In the meantime, though not shown, it is preferable that the steam generator 300, the pimp 320, and the valves 341 and 351 are electronically controlled by a control unit (not shown).

Referring to FIG. 3, a process for washing an inside of the steam generator 300 will be described.

The control unit determines whether to wash the steam generator 300 and a washing time. Whether to wash the steam generator 300 is determined taking operation efficiency of the steam generator 300 into account. The operation efficiency may be determined taking a water boiling time in the steam generator 300 into account.

For an example, it may be determined that the operation efficiency of the steam generator 300 is dropped below a reference valve if a time period of a temperature rise from a first temperature to a second temperature takes longer than the reference time period. Of course, the first and second temperatures are not limited, but variable, appropriately. Though not shown, in order to sense the temperatures, a temperature sensor may be provided to the inside of the steam generator 300.

As another example, a temperature of the inside of the steam generator 300 can be utilized on an occasion the steam generator 300 has been operated for a preset time period. For an example, if the temperature of the water is sensed to be below the reference value on an occasion the steam generator 300 has been operated for a preset time period, it can be determined that the efficiency of the steam generator 300 is dropped below the reference value.

As another example, a heat generation rate of the heater in the steam generator 300 may be used. The heat generation rate of the heater is a calorific value the water obtains in the steam generator 300 per unit time period that can be calculated from a temperature rise of the water during the unit time period. If it is determined that the heat generation rate of the heater is below a reference value, it can be determined that the operation efficiency of the steam generator 300 is dropped below the reference value.

As described before, if it is determined that the operation efficiency of the steam generator 300 is dropped below the reference value, it is determined that washing of the inside of the steam generator 300 is necessary.

Then, a washing time is determined; if it is determined that the washing is necessary, it may be determined that the washing of the inside of the steam generator 300 is performed at once automatically, or after a preset time period.

For an example, if the steam generator 300 is in use presently, it can be efficient that the use of the steam generator 300 is finished. The washing time is determined to be after the finish of the use.

An embodiment in FIG. 4 illustrates a case when the water container 310 is not included to the laundry machine. The laundry machine of the embodiment includes a discharge flow passage 370 for discharging liquid from the steam generator 300. Of descriptions of the system in FIG. 4, portions duplicated with FIG. 3 will be omitted.

Though not shown, the discharge flow passage 370 is connected to a tub (not shown) or a drain unit (not shown) for discharging the washing water from the tub to an outside of the laundry machine. The drain unit may include a drain pimp (not shown) and a drain hose (not shown).

In the example of FIG. 3, though the liquid may be discharged from the steam generator 300 to the outside of the laundry machine through the water container 310 after washing, in the example of FIG. 4, the liquid is discharged through the discharge flow passage 370. That is, the control unit opens the discharge valve 371 to discharge the liquid from the steam generator 300 to the outside of the laundry machine.

In detail, in a case the steam generator 300 is washed, the control unit opens the discharge valve 371 on the discharge flow passage 370, for discharging remained water from the steam generator 300 to the outside of the laundry machine.

Then, if it is determined that the discharge is finished as a preset time period is passed, the detergent liquid valve 341 is opened, and the pump 320 is driven in the regular direction, for pimping the detergent liquid from the detergent liquid container 360 to the steam generator 300.

Once the washing is finished, the discharge valve 371 is opened again, and the liquid is discharged from the steam generator 300 to the outside of the laundry machine.

In the examples of FIGS. 3 and 4, after the detergent liquid is supplied to the steam generator 300, the steam generator 300 may be left as it is for about 1-2 hours, for waiting a time period in which the detergent liquid dissolves the contaminants in the steam generator 300, for an example, the calcareous, enough to separate the contaminants from an inside surface of the steam generator 300.

In this case, the detergent liquid may include weak acid because calcareous dissolves in the weak acid, well. The weak acid may include, for an example, vinegar which is obtainable, easily.

In the meantime, FIG. 5 illustrates a flow chart showing the steps of a method for controlling a laundry machine as shown in FIG. 3.

At first, the control unit puts the steam generator 300 into operation (S10).

Then, the control unit determines whether the operation efficiency of the steam generator 300 is below a reference value or not (S20). The method for determining the operation efficiency of the steam generator 300 is described in detail in the description with reference to FIG. 3, detailed description of the method will be omitted. In a case it is determined that the efficiency is not below the reference value, the operation of the steam generator 300 is maintained as it is.

However, if it is determined that the efficiency is below the reference value, it is determined whether the use of steam generator 300 is finished or not (S40). If the use of steam generator 300 is not finished yet, the operation of the steam generator 300 is maintained as it is.

If the use of steam generator 300 is finished, the remained water is drained from the steam generator 300 (S50). In this case, the pump 320 is driven in the reverse direction for a preset time period for pimping the remained water from the steam generator 300 to the water container. In this instance, the detergent liquid valve 341 is maintained closed, and the water valve 351 is maintained opened.

Though finish of the use of the steam generator 300 is determined in above case, the determining step may not be taken. That is, if it is determined that the efficiency of the steam generator 300 is below the reference value (S40), the steam generator 300 may be stopped and the pimp 320 may be driven in the reverse direction.

Or, the determination of the finish of the use of the steam generator 300 may be determined with reference to finish of supply of required steam. In the related art too, after supply of the required steam from the steam generator 300, the operation of the steam generator 300 is finished. Such a state may be a state the use of the steam generator 300 is finished.

After the remained water is discharged from the steam generator 300, the detergent liquid is supplied to the steam generator (S60). In this case, the pump 320 is stopped, the water valve 351 is closed, and the detergent liquid valve 341 is opened. Then, the pump 320 is driven in the regular direction for a preset time period again, for pimping the detergent liquid from the detergent liquid container 360 to the steam generator 300.

In the meantime, after the supply of the detergent liquid to the steam generator 300 thus, it is preferable that the steam generator 300 is maintained as it is in a state the detergent liquid is held in the steam generator 300 for a preset time period, about 1 to 2 hours. That is, as described before, it is for waiting a time period in which the detergent liquid dissolves the contaminants in the steam generator 300, for an example, the calcareous, enough to separate the contaminants from the inside surface of the steam generator 300.

Then, upon lapse of the preset time period, the water is drained from the steam generator 300 (S80). In this case, the pimp 320 is driven in the reverse direction again, to pump the liquid from the steam generator 300 to the water container 310. In this instance, the water valve 351 is in an opened state, and the detergent liquid valve 341 is in a closed state.

Upon finishing the washing through above steps, the user detaches the water container 310 from the laundry machine, and drains the liquid in the water container 310 to an outside of the water container 310.

INDUSTRIAL APPLICABILITY

The present invention permits to washing an inside of a steam generator provided in a laundry machine.

Particularly, as contaminants in the steam generator, calcareous can be removed from the inside of the steam generator, permitting to prevent efficiency of the steam generator from dropping.

If the washing time of the inside of the steam generator is determined taking efficiency of the steam generator into account, the efficiency of the steam generator can always be maintained higher than an appropriate level, and waste of energy can be prevented.

The invention claimed is:

1. A laundry machine comprising:

a cabinet body;

a tub mounted inside the cabinet body;

a drum rotatably mounted in the tub;

a steam generator having a heater for generating and supplying steam to the drum;

a detergent liquid flow passage for providing a passage to supply detergent liquid to an inside of the steam generator; and a detergent liquid container directly connected to the detergent liquid flow passage for holding the detergent liquid.

2. The laundry machine as claimed in claim 1, wherein the detergent liquid container is detachable.

3. The laundry machine as claimed in claim 1, further comprising a water container for holding water to be supplied to the steam generator, and a water flow passage connected between the steam generator and the water container.

4. The laundry machine as claimed in claim 3, wherein the water container is detachable.

5. The laundry machine as claimed in claim 3, further comprising a pump mounted to the detergent liquid flow passage or the water flow passage for running in a regular or reverse direction, selectively.

6. The laundry machine as claimed in claim 5, further comprising:

a detergent liquid valve mounted to the detergent liquid flow passage for making selective communication between the steam generator and the detergent liquid container, and a water valve mounted to the water flow passage for making selective communication between the steam generator and the water container.

7. The laundry machine as claimed in claim 5, further comprising:

a three-way valve for making selective communication between the steam generator and the detergent liquid flow passage or the water flow passage.

8. The laundry machine as claimed in claim 5, further comprising a control unit to determine whether to wash the steam generator or not.

9. The laundry machine as claimed in claim 8, wherein the control unit makes the determination based on a temperature of the water in the steam generator.

10. The laundry machine as claimed in claim 9, wherein the control unit for the determination, compares to a reference time period a time period taken for the temperature to rise from a preset first temperature to a preset second temperature.

11. The laundry machine as claimed in claim 9, wherein the control unit, for the determination, compares to the reference temperature the water temperature after the water has been is heated for a preset time period.

12. The laundry machine as claimed in claim 8, wherein the control unit makes the determination based on a heat generation rate of the heater in the steam generator.

13. The laundry machine as claimed in claim 8, wherein the control unit controls the laundry machine such that the steam generator is washed after the steam generator is stopped.

14. The laundry machine as claimed in claim 1, further comprising a discharge flow passage for discharging the liquid from the steam generator to at least one of the tub, the washing water discharge pump, and the washing water discharge hose.

15. A method for controlling a laundry machine having a cabinet body, a tub, a drum, a steam generator, and a detergent liquid container, the method comprising:

determining whether to wash the steam generator or not;

discharging remaining water from the steam generator upon determining to wash the steam generator;

supplying detergent liquid from the detergent liquid container to the inside of the steam generator; and discharging the detergent liquid from the inside of the steam generator.

16. The method as claimed in claim 15, wherein the determining includes sensing a temperature of the water in the steam generator for the determination.

17. The method as claimed in claim 16, wherein the step of determining further includes comparing to a reference time period a time period taken for the temperature of the water to rise from a first temperature to a second temperature or comparing to a reference temperature a temperature of the water after the steam generator is heated for a predetermined time period.

18. The method as claimed in claim 15, wherein the determining includes sensing a heat generation rate of a heater in the steam generator.

19. The method as claimed in claim 15, further comprising determining a washing time of the steam generator.

20. The method as claimed in claim 15, wherein the discharging of the remaining water includes discharging the remaining water from the steam generator to a water container to an outside of the laundry machine.

21. The method as claimed in claim 15, wherein the detergent liquid includes weak acid.

22. The method as claimed in claim 15, wherein the supplying of the detergent liquid includes waiting for a preset time period.

* * * * *